US008899708B2

(12) United States Patent
Ito et al.

(10) Patent No.: US 8,899,708 B2
(45) Date of Patent: Dec. 2, 2014

(54) IMAGE FORMING APPARATUS, COMPUTER-READABLE STORAGE MEDIUM, AND IMAGE FORMING METHOD

(75) Inventors: Takayuki Ito, Kanagawa (JP); Shigetaka Sakakibara, Kanagawa (JP)

(73) Assignee: Ricoh Company, Limited, Tokyo (JP)

( * ) Notice: Subject to any disclaimer, the term of this patent is extended or adjusted under 35 U.S.C. 154(b) by 150 days.

(21) Appl. No.: 13/411,666

(22) Filed: Mar. 5, 2012

(65) Prior Publication Data

US 2012/0236054 A1 Sep. 20, 2012

(30) Foreign Application Priority Data

Mar. 14, 2011 (JP) ..... 2011-055436

(51) Int. Cl.
*B41J 29/38* (2006.01)
*B41J 2/015* (2006.01)
*B41J 19/14* (2006.01)

(52) U.S. Cl.
CPC ..... *B41J 19/145* (2013.01); *B41J 19/147* (2013.01)
USPC ..... 347/9; 347/12; 347/20

(58) Field of Classification Search
USPC ..... 347/9, 12, 15, 41, 43, 20
See application file for complete search history.

(56) References Cited

U.S. PATENT DOCUMENTS 6,290,329 B1 * 9/2001 Terasawa et al. ..... 347/43
6,695,422 B1 2/2004 Otsuki
6,866,365 B1 3/2005 Neese et al.
2002/0063750 A1 5/2002 Kanda et al.
2007/0019022 A1 1/2007 Otsuka et al.
2008/0106581 A1 * 5/2008 Sanada et al. ..... 347/86

FOREIGN PATENT DOCUMENTS

EP 1 142 714 10/2001
EP 1 658 988 5/2006
JP 2001-260423 A 9/2001
JP 2002-307672 A 10/2002
JP 2003-025614 A 1/2003
JP 2004-066601 A 3/2004
JP 2004-106392 A 4/2004
JP 2010-208164 A 9/2010

OTHER PUBLICATIONS

European Search Report dated Jun. 20, 2012.

* cited by examiner

*Primary Examiner* — Jason Uhlenhake
(74) *Attorney, Agent, or Firm* — Harness, Dickey & Pierce, P.L.C.

(57) ABSTRACT

An image forming apparatus includes a carriage that includes a head including a black nozzle array in which a plurality of nozzles are arranged and a color nozzle array in which a plurality of nozzles are arrange, the black nozzle array being disposed at a position shifted in the sub-scanning direction downstream in a medium conveying direction with respect to the color nozzle array; a conveying unit configured to convey a recording medium in a sub-scanning direction; and a control unit. The control unit forms an image by the color nozzle array in a main scanning in one direction, relatively moves the recording medium to a subsequent main-scanning position thereafter, and forms an image by the black nozzle array on the image formed by the color nozzle array in a following main scanning in the other direction so as to complete an image for one scanning area.

12 Claims, 9 Drawing Sheets

IMAGE FORMING APPARATUS, COMPUTER-READABLE STORAGE MEDIUM, AND IMAGE FORMING METHOD

CROSS-REFERENCE TO RELATED APPLICATIONS

The present application claims priority to and incorporates by reference the entire contents of Japanese Patent Application No. 2011-055436 filed in Japan on Mar. 14, 2011.

BACKGROUND OF THE INVENTION

1. Field of the Invention

The present invention relates to an image forming apparatus, a computer-readable storage medium, and an image forming method.

2. Description of the Related Art

As an example of an image forming apparatus such as a printer, a facsimile, a copying machine, a plotter, and Multi-Function Peripherals (MFP) including the foregoing, an ink-jet recording apparatus and the like is known as a droplet ejecting recording type image forming apparatus using a recording head composed of a liquid ejecting head (droplet ejecting head) that ejects ink droplets. The liquid ejecting recording type image forming apparatus is an apparatus that ejects ink droplets from a recording head to a sheet conveyed (not restricted to paper, but meant to be a medium on which ink droplets or other liquid can adhere including an OHP transparency, and also referred to as a recording medium, recording paper, a recording sheet, and the like) to perform image formation (recording, printing, and imaging are also used as synonyms). Examples of the liquid ejecting recording type image forming apparatus include a serial type image forming apparatus in which a recording head ejects droplets while moving in a main-scanning direction to form an image and a line type image forming apparatus that uses a line head in which a recording head in a stationary condition ejects droplets to form an image.

In the present application, a liquid ejecting recording type image forming apparatus means an apparatus that carries out image formation by ejecting liquid to media such as paper, yarn, textile, fabric, leather, metal, plastic, glass, wood, and ceramics. Image formation means not only to give an image that has meaning of characters, graphics, and such to a medium, but also means to give an image that has no meaning such as patterns to a medium (simply making droplets land on a medium). Ink is not restricted to that referred to as ink, but is used as a generic name for all liquid that can perform image formation such as that referred to as recording liquid, fixing liquid, liquid, and the like, and includes, for example, DNA samples, resists, pattern material, and resin. An image is not limited to a planar image, but includes an image given to a three-dimensionally formed object and an image formed by three-dimensionally shaping a solid body.

In a serial type image forming apparatus, a carriage mounted with a recording head is moved for scanning in a main-scanning direction and a sheet that is a recording medium is conveyed intermittently, whereby an image is formed on the sheet. In such an image forming apparatus, when forming a color image by one main-scanning (one scan), at the time bidirectional printing that forms an image by reciprocating motions of the carriage is carried out, a color difference (bidirectional color difference) due to deviation in landing positions of droplets occurs. In addition, dot density becomes coarse because resolution relies on the pitch of a nozzle. As a result, image quality deteriorates.

Conventionally known are various technologies that achieve high image quality by making black color high in resolution only for color image formation (Japanese Patent Application Laid-open No. 2003-025614 and Japanese Patent Application Laid-open No. 2001-260423) and another technology that attempts to reduce bidirectional color difference by disposing nozzles that eject color droplets shifted in a nozzle array direction to unify the order of landing for bidirectional printing (Japanese Patent Application Laid-open No. 2004-106392).

Further known as a serial type image forming apparatus is an apparatus in which a black nozzle array arranged with a plurality of nozzles that eject black droplets and color nozzle arrays arranged with a plurality of nozzles that eject color droplets are disposed such that the black nozzle array is shifted by one head portion (for one nozzle array) in a sub-scanning direction downstream in a medium conveying direction with respect to the color nozzle arrays (Japanese Patent Application Laid-open No. 2010-208164).

Various arrangements are known for the head disposition to reduce bidirectional color difference mentioned above. Among them, the simplest configuration includes, for example, a plurality of heads that eject droplets of the same colors, with the heads being arranged in the reverse order in the same main-scanning direction as in the order of K, C, M, Y, M, C, and K, whereby different heads are used for out-bound and in-bound scans, and droplets are ejected constantly in the order of Y, M, C, and K so as to make the landing order of droplets of the respective colors the same for the out-bound and in-bound scans.

Adapting such a configuration reduces bidirectional difference. In addition, because a previously landed color becomes predominant, making black droplets land last can improve gray quality. In such a configuration, however, the number of heads is large.

Therefore, there is a need for an image forming apparatus capable of reducing bidirectional color difference with a simple head disposition.

SUMMARY OF THE INVENTION

It is an object of the present invention to at least partially solve the problems in the conventional technology.

According to an embodiment, there is provided an image forming apparatus that includes a carriage that includes at least one head and is moved for scanning in a main-scanning direction, the head including a black nozzle array in which a plurality of nozzles for ejecting black droplets are arranged and a color nozzle array in which a plurality of nozzles for ejecting color droplets are arrange, the black nozzle array being disposed at a position shifted in a sub-scanning direction downstream in a medium conveying direction with respect to the color nozzle array; a conveying unit configured to convey a recording medium in the sub-scanning direction; and a control unit that performs control in a manner that forms an image by the color nozzle array in a main scanning in one direction, relatively moves the recording medium to a subsequent main-scanning position thereafter, and forms an image by the black nozzle array on the image formed by the color nozzle array in a following main scanning in the other direction so as to complete an image for one scanning area.

According to another embodiment, there is provided a non-transitory computer-readable storage medium with an executable program for controlling an image forming apparatus and stored thereon. The image forming apparatus includes a carriage that includes at least one head and is moved for scanning in a main-scanning direction, the head including a black nozzle array in which a plurality of nozzles for ejecting black droplets are arranged and a color nozzle array in which a plurality of nozzles for ejecting color droplets are arrange, the black nozzle array being disposed at a position shifted in a sub-scanning direction downstream in a medium conveying direction with respect to the color nozzle array, and a conveying unit configured to convey a recording medium in the sub-scanning direction. The program instructs a computer to perform forming an image by the color nozzle array in a main scanning in one direction; relatively moving the recording medium to a subsequent main-scanning position thereafter; and forming an image by the black nozzle array on the image formed by the color nozzle array in a following main scanning in the other direction so as to complete an image for one scanning area.

According to still another embodiment, there is provided an image forming method for controlling an image forming apparatus. The image forming apparatus includes a carriage that includes at least one head and is moved for scanning in a main-scanning direction, the head including a black nozzle array in which a plurality of nozzles for ejecting black droplets are arranged and a color nozzle array in which a plurality of nozzles for ejecting color droplets are arrange, the black nozzle array being disposed at a position shifted in a sub-scanning direction downstream in a medium conveying direction with respect to the color nozzle array, and a conveying unit configured to convey a recording medium in the sub-scanning direction. The image forming method includes forming an image by the color nozzle array in a main scanning in one direction; relatively moving the recording medium to a subsequent main-scanning position thereafter; and forming an image by the black nozzle array on the image formed by the color nozzle array in a following main scanning in the other direction so as to complete an image for one scanning area.

The above and other objects, features, advantages and technical and industrial significance of this invention will be better understood by reading the following detailed description of presently preferred embodiments of the invention, when considered in connection with the accompanying drawings.

DETAILED DESCRIPTION OF THE PREFERRED EMBODIMENTS

Figure 1:
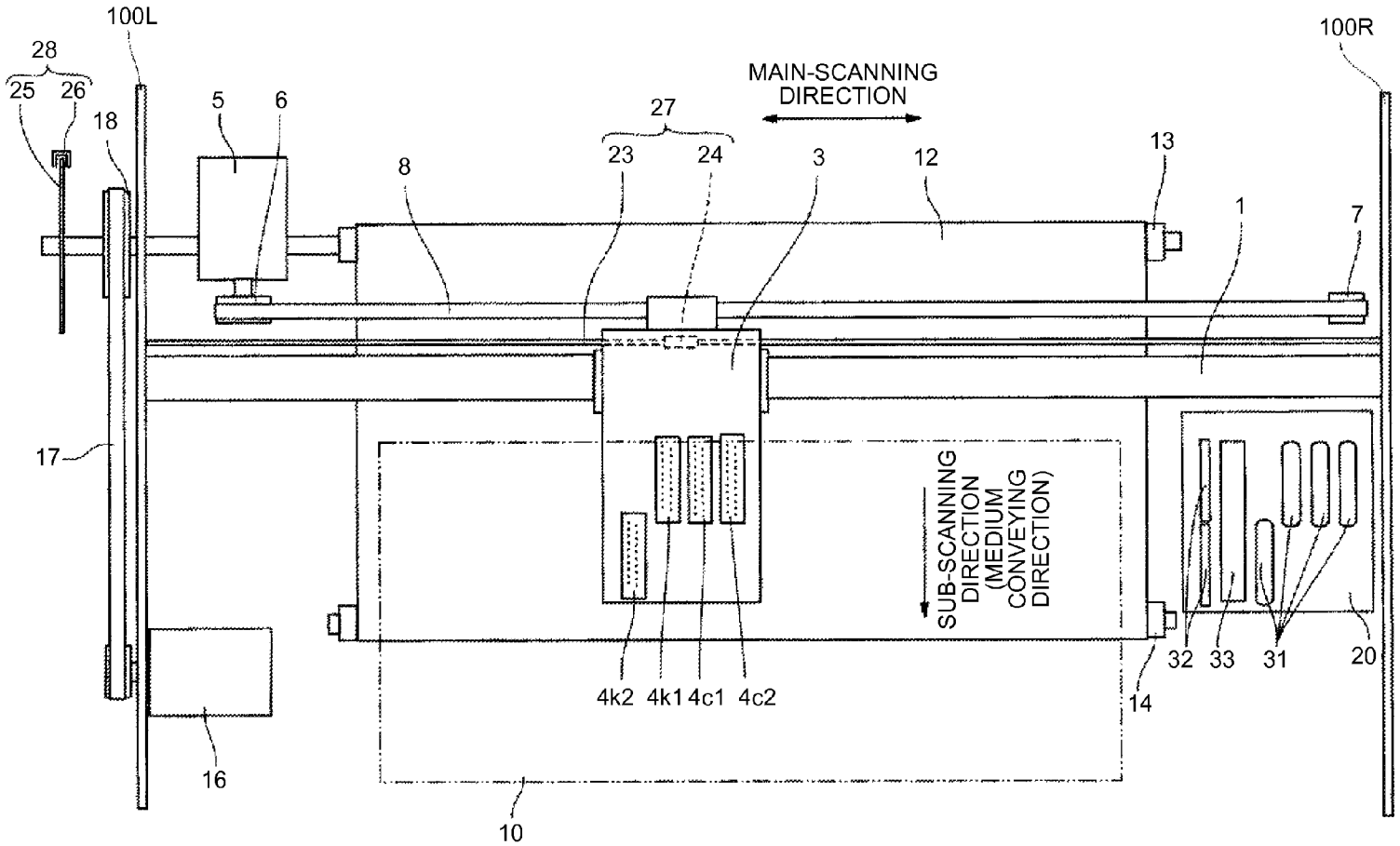
FIG. 1 is an explanatory plan view of a relevant portion of a mechanism in an image forming apparatus according to a first embodiment of the present invention.
Figure 2:
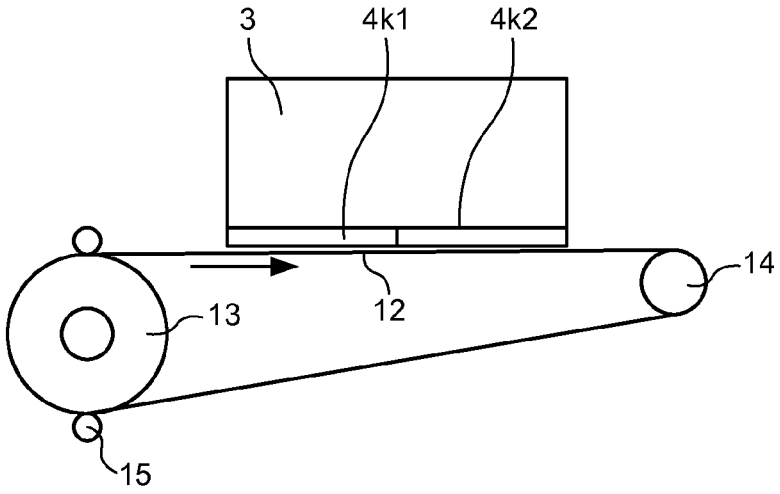
FIG. 2 is an explanatory side view of the mechanism.

Exemplary embodiments of the present invention will be described below with reference to the accompanying drawings. An example of an image forming apparatus to which the invention is applied will be described with reference to FIGS. 1 and 2. FIG. 1 is an explanatory plan view of a relevant portion of mechanism in the image forming apparatus, and FIG. 2 is an explanatory side view of the mechanism.

The image forming apparatus is a serial type image forming apparatus, and a carriage 3 is held to slide by a main guide rod 1 laterally bridged between a left side plate 100L and a right side plate 100R and by driven guide members not illustrated, and by a main-scanning motor 5, the carriage 3 scans and moves in a main-scanning direction via a timing belt 8 wound between a drive pulley 6 and a driven pulley 7.

On the carriage 3, a first black head **4*k*1, a second black head 4*k*2, a first color head 4*c*1, and a second color head 4*c*2 are mounted. In the following, the first color head 4*c*1 and the second color head 4*c*2 are collectively referred to as color heads 4*c*, and when not distinguishing the respective heads, the heads are referred to as heads 4**.

Figure 3:
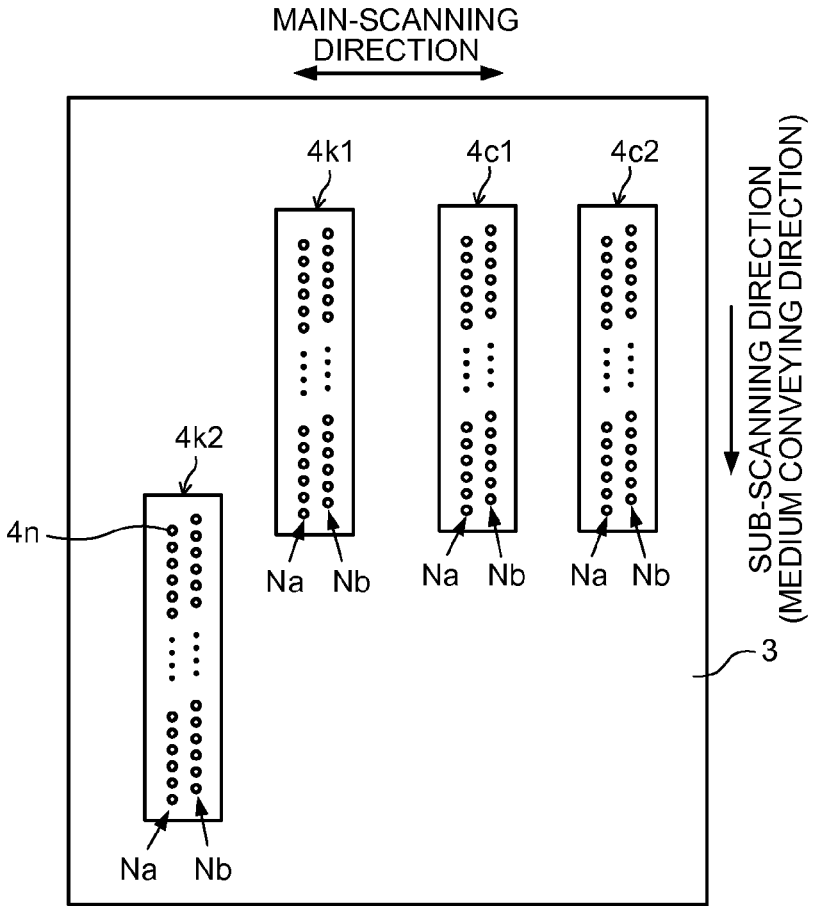
FIG. 3 is a plan view for explaining a configuration of heads in the mechanism.

Each of the heads 4, as illustrated in FIG. 3 (a plan view in a transparent condition), has two nozzle arrays Na and Nb each with a plurality of nozzles **4*n*** that eject droplets arranged in a sub-scanning direction (a direction orthogonal to the main-scanning direction).

The first black head **4*k*1 ejects black (K) droplets from both of the nozzle arrays Na and Nb, the first color head 4*c*1 ejects yellow (Y) droplets from the nozzle array Na and ejects magenta (M) droplets from the nozzle array Nb, and the second color head 4*c*2 ejects cyan (C) droplets from the nozzle array Na. The nozzle array Nb of the second color head 4*c*2 is an unused nozzle array (or a nozzle array that ejects fixing liquid). The second black head 4*k*2** ejects black (K) droplets from both of the nozzle arrays Na and Nb.

Accordingly, the nozzle density of each of the first black head **4*k*1 and the second black head 4*k*2 is twice as much as that of each color of the first color head 4*c*1 and the second color head 4*c*2** that each eject color droplets.

The first black head **4*k*1, the first color head 4*c*1, and the second color head 4*c*2 are disposed at the same position in the sub-scanning direction in parallel with one another in the main-scanning direction. The second black head 4*k*2 is disposed at a position shifted by an amount equivalent to the width of one nozzle array in the sub-scanning direction downstream in a sheet conveying direction with respect to the first black head 4*k*1, the first color head 4*c*1, and the second color head 4*c*2. In other words, in the present embodiment, the second black head 4*k*2 corresponds to a black nozzle array, and the first color head 4*c*1 and the second color head 4*c*2** correspond to color nozzle arrays.

Meanwhile, to convey a sheet, provided is a conveying belt 12 that is a conveying unit for electrostatically attracting and conveying the sheet at a position facing the recording heads 4. The conveying belt 12 is an endless belt configured to be wound between a conveying roller 13 and a tension roller 14 to revolve in a belt conveying direction (sub-scanning direction), and is charged (electrical charge imparted) by a charging roller 15 (see FIG. 2) while revolving.

The conveying belt 12 is revolved and moved in the sub-scanning direction by the conveying roller 13 rotary driven by a sub-scanning motor 16 via a timing belt 17 and a timing pulley 18.

On one side of the carriage 3 in the main-scanning direction, a maintenance recovery mechanism 20 that performs maintenance and recovery of the recording heads 4 is disposed lateral to the conveying belt 12. On the other of the carriage 3 in the main-scanning direction, an idle ejecting receiver (not shown in the drawings) that performs idle ejecting from the heads 4 is disposed lateral to the conveying belt 12.

The maintenance recovery mechanism 20 is configured with, for example, four pieces of cap members 31 that cap nozzle faces (nozzle formed surfaces) of the recording heads 4, wiper members 32 that sweep away the nozzle faces, and an idle ejecting receiver 33 that receives droplets not contributing to image forming (idle ejecting droplets).

Furthermore, an encoder scale 23 formed with a given pattern (also referred to as a position identifier, a scale, slits, and such, and hereinafter, referred to as slits) is stretched between the both side plates along the main-scanning direction of the carriage 3. An encoder sensor 24 composed of a transmission type photo sensor that reads the slits of the encoder scale 23 is provided on the carriage 3. The encoder scale 23 and the encoder sensor 24 constitute a linear encoder (main-scanning encoder) 27 that detects the movement of the carriage 3.

On the shaft of the conveying roller 13, an encoder scale (a code wheel) 25 is attached, and an encoder sensor 26 composed of a transmission type photo sensor that detects a pattern (slits) formed on the encoder scale 25 is provided. The encoder scale 25 and the encoder sensor 26 constitute a rotary encoder (a sub-scanning encoder) 28 that detects a moving amount and a moving position of the conveying belt 12.

In the image forming apparatus thus configured, a sheet 10 from a paper cassette not illustrated is fed to and attracted on the charged conveying belt 12. By the revolving of the conveying belt 12, the sheet 10 is conveyed in the sub-scanning direction. Then, while the carriage 3 is moving in the main-scanning direction, the heads 4 are driven corresponding to an image signal ejecting ink droplets onto the sheet 10 at rest to record for one line. After conveying the sheet 10 for a predetermined amount, recording for a subsequent line is carried out. By receiving a record ending signal or a signal indicative of the trailing end of the sheet 10 reaching a recording area, the recording operation is finished and the sheet 10 is discharged to a discharge tray.

Figure 4:
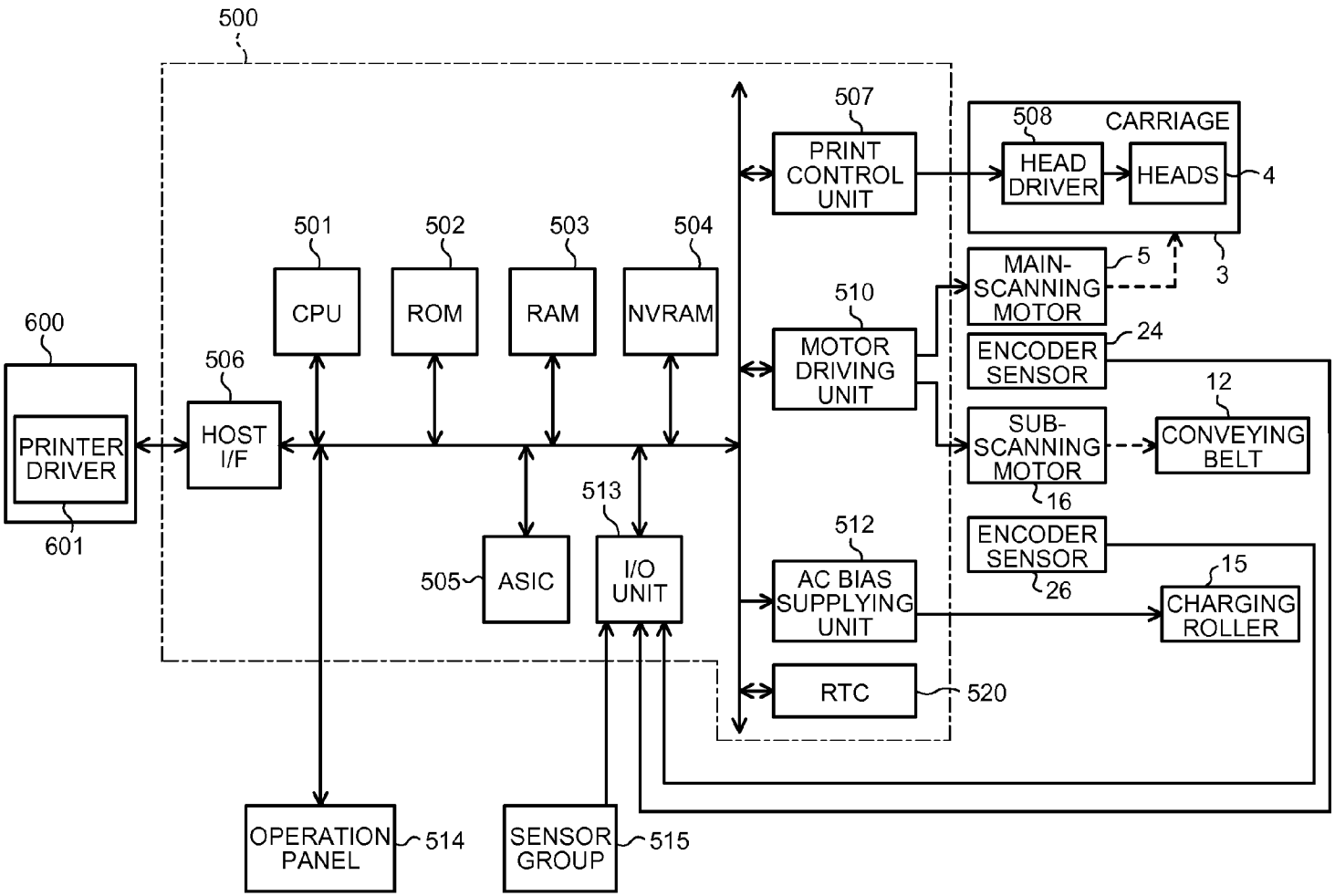
FIG. 4 is a block diagram illustrating an overview of a control unit of the apparatus.

Next, an overview of a control unit of the image forming apparatus will be described with reference to FIG. 4. FIG. 4 is an explanatory block diagram of the control unit.

The control unit 500 includes a CPU 501 that manages overall control of the apparatus, a ROM 502 that stores therein various computer programs including a computer program according to the invention that causes the CPU 501 to perform control (processing) concerning carriage movement, sheet conveying, and droplet ejecting according to the invention and other fixed data, a RAM 503 that temporarily stores therein image data and such, a rewritable non-volatile memory (NVRAM) 504 for retaining data even while the apparatus is powered off, and an Application Specific Integrated Circuit (ASIC) 505 that processes image processing in which various signal processing, reordering, and the like to image data are performed and processes other input/output signals for controlling the whole apparatus.

The control unit 500 further includes a print control unit 507 that includes a data transferring unit and a drive signal generator for drive controlling each of the heads 4, a head driver (driver IC) 508 for driving each of the heads 4 which is provided on the carriage 3, a motor driving unit 510 for driving the main-scanning motor 5 that scans and moves the carriage 3 and the sub-scanning motor 16 that makes the conveying belt 12 revolve, and an AC bias supplying unit 512 that supplies AC bias to the charging roller 15.

An I/O unit 513 is used to acquire information from the encoder sensor 24 of the main-scanning encoder 27, the encoder sensor 26 of the sub-scanning encoder 28, and a sensor group 515 of various sensors mounted on the apparatus to extract information necessary for printer control so as to control the print control unit 507, the motor driving unit 510, and an AC bias supplying unit 512. The sensor group 515 includes optical sensors to detect sheet positions, thermistors to monitor internal temperature and humidity, sensors to monitor a voltage of the charged belt, and interlock switches for detecting opening/closing of covers, and thus, the I/O unit 513 can process various types of sensor information.

The CPU 501 calculates a drive output value (control value) for the main-scanning motor 5 based on a detected speed value and a detected position value acquired by sampling detection pulses from the encoder sensor 24 constituting the main-scanning encoder 27 and a target speed value and a target position value acquired from a speed and position profile stored in advance so as to drive the main-scanning motor 5 via the motor driving unit 510. Likewise, the CPU 501 calculates a drive output value (control value) for the sub-scanning motor 16 based on a detected speed value and a detected position value acquired by sampling detection pulses from the encoder sensor 26 constituting the sub-scanning encoder 28 and a target speed value and a target position value acquired from a speed and position profile stored in advance so as to drive the sub-scanning motor 16 via the motor driving unit 510.

Furthermore, the control unit 500 is connected with an operation panel 514 for inputting necessary information for the apparatus and for displaying. The control unit 500 further includes a real time clock (RTC) 520 that is a timer that keeps the current time (year, month, day, and time).

The control unit 500 has a host I/F 506 for sending and receiving data and signals with a host. The host I/F 506 receives the data and signals from a host 600 such as an information processing apparatus like a personal computer, an image reading apparatus like an image scanner, and an imaging apparatus like a digital camera via a cable or a network.

The CPU 501 of the control unit 500 then reads out and analyzes print data in a receive buffer included in the host I/F 506, carries out necessary processes of image processing, data reordering, and such in the ASIC 505, and transfers the image data to the head driver 508 via the print control unit 507. The generation of dot pattern data to output an image is carried out by a printer driver 601 of the host 600.

The print control unit 507 further includes a drive signal generator constituted by a D/A converter that D/A converts pattern data of drive pulses stored in the ROM 502, a voltage amplifier, a current amplifier, and the like. Other than transferring the image data in serial data and outputting a transfer clock, a latch signal, a control signal, and the like that are necessary to transfer the image data, to determine the transfer, or the like to the head driver 508, the print control unit 507 outputs a drive signal constituted by a single drive pulse or a plurality of drive pulses to the head driver 508.

The head driver 508 selectively applies, based on the serially received image data of the heads 4 equivalent to one line, a drive pulse constituting a drive signal given from the print control unit 507 to a drive element (for example, piezoelectric element) that generates energy to eject droplets of the heads 4 to drive the heads 4. At this time, selecting a drive pulse constituting a drive signal allows droplets of different drop amount, for example, large droplets, medium droplets, and small droplets to be ejected, whereby dots of different sizes can be shot.

When the CPU 501 controls the respective units by the computer program stored in the ROM 502 to form an image equivalent to the width of one nozzle array by one scan of the carriage 3, the CPU 501 carries out a process of ejecting droplets from each nozzle array of the first color head 4*c*1 and the second color head 4*c*2 corresponding to the image equivalent to the width of one nozzle array by the current scanning, a process of relatively moving the sheet 10 to a subsequent main-scanning position, and a process of forming the image for one nozzle array by ejecting droplets from each nozzle array of the second black head 4*k*2 corresponding to the image equivalent to the width of one nozzle array in the subsequent main-scanning.

Next, an image forming operation in a first embodiment of the invention will be described with reference to FIG. 5.

Figure 5:
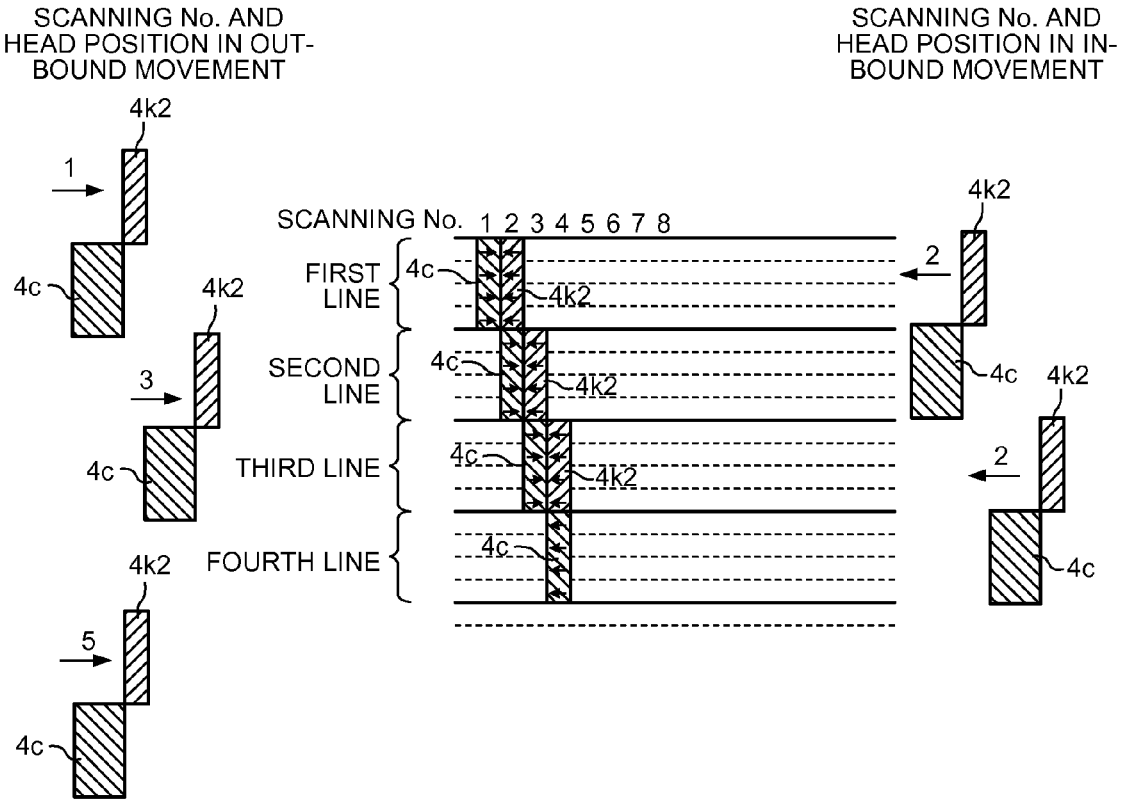
FIG. 5 is a diagram for explaining an image forming operation in the first embodiment of the invention.

In FIG. 5, an out-bound direction of the carriage 3 is defined as right direction, an in-bound direction thereof is defined as left direction, and the sheet conveying direction is defined as an upward direction from bottom to top (heads relatively move in a top to bottom direction). An area corresponding to one time of main-scanning of the carriage 3 is referred to as "one main-scanning area" and an area on a medium corresponding to the one main-scanning area is referred to as "one line portion", and the width of the one main-scanning area, i.e., one line, in the sub-scanning direction is equivalent to the width of a nozzle array.

The carriage 3 is first moved for scanning in the out-bound direction in main-scanning and the color heads 4*c* are driven to eject color droplets so as to form an image for one line portion by the color droplets at the first line. At this time, the second black head 4*k*2 is not used because it is disposed downstream in a medium conveying direction.

After the image of one line portion is formed by the color heads 4*c* at the first line, the sheet 10 is then conveyed for one line portion. Accordingly, the color heads 4*c* move to the second line area and the second black head 4*k*2 moves to the first line area.

The carriage 3 is then moved for scanning in the in-bound direction in main-scanning and the second black head 4*k*2 is driven to eject black droplets so as to form an image by the black droplets over the image formed by the color heads 4*c* in the first line area. This completes the whole image of one line portion (one main-scanning area) for the first line.

At the same time, the color heads 4*c* are driven to eject color droplets to form an image of one line portion by the color droplets at the second line.

After the image of one line portion is formed, the sheet 10 is then conveyed for one line portion. Accordingly, the color heads 4*c* move to the third line area and the second black head 4*k*2 moves to the second line area.

The carriage 3 is moved for scanning in the out-bound direction in main-scanning and the second black head 4*k*2 is driven to eject black droplets so as to form an image by the black droplets over the image formed by the color heads 4*c* in the second line area. This completes the whole image of one line portion for the second line.

At the same time, the color heads 4*c* are driven to eject color droplets to form an image of one line portion at the third line by the color droplets.

As in the foregoing, on an image formed by the color heads 4*c* in a preceding main-scanning in one direction, an image is formed by the second black head 4*k*2 ejecting black droplets in the following main-scanning in the other direction so as to complete the image. In the above-described example, with the first line and the second line, the main-scanning of the first line is the preceding main-scanning in one direction and the main-scanning of the second line is the following main-scanning in the other direction. With the second line and the third line, the main-scanning of the second line is the preceding main-scanning in one direction and the main-scanning of the third line is the following main-scanning in the other direction. In other words, the one direction and the other direction here mean the scanning directions in an opposite relationship, not corresponding to the out-bound and in-bound directions.

Accordingly, the black droplets by the black head are always shot last and, because the droplets landed later pass over the droplets landed earlier due to penetration characteristics of liquid, the color landed earlier becomes predominant, whereby the bidirectional color difference of gray can be reduced and thus, quality can be improved.

Furthermore, by adjusting the position of the black nozzle array or a stop time between the out-bound and in-bound scans, the landing time of color droplets and the landing time of black droplets can be changed, whereby the density of gray and the bleeding of black on a color background can be controlled. This is because, although an earlier landed color becomes predominant as described above, it is different when the color is dried and thus, varying the drying time of color droplets shot earlier can vary the penetration characteristics.

As in the foregoing, making the resolution of the black head (black nozzle array) higher than that of the color heads (color nozzle arrays) can improve the image quality of black image when forming an image by one scan, and because dots can be finely disposed when depicting gray (when depicting gray with black and color material other than black), granularity can be lowered.

Figure 6:
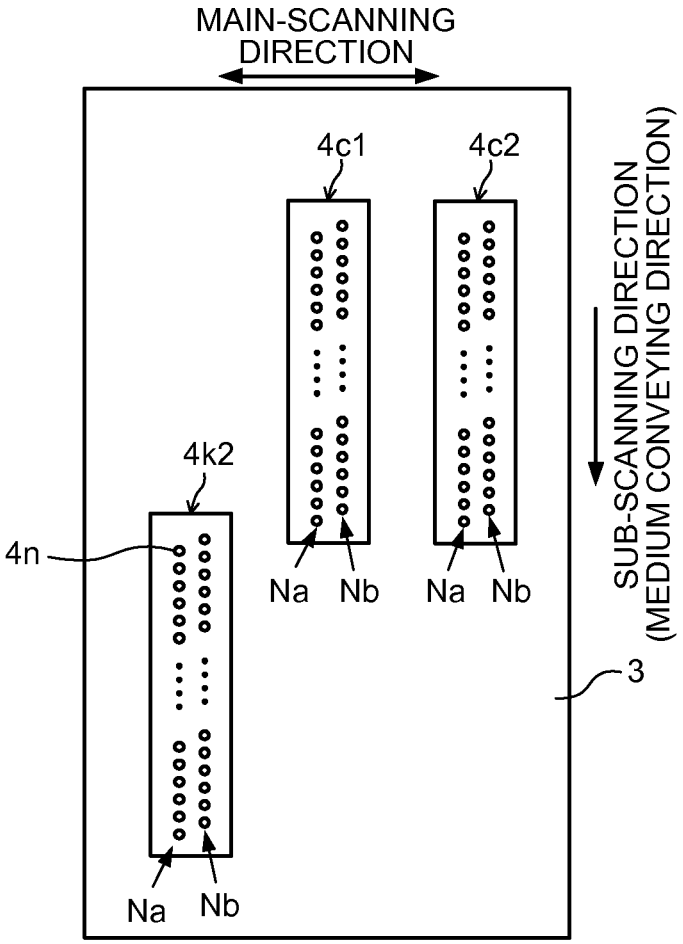
FIG. 6 is a diagram for explaining a configuration of heads in a second embodiment of the invention.

Next, a second embodiment of the invention will be described with reference to FIG. 6. FIG. 6 is a schematic diagram for explaining a head arrangement in the second embodiment.

In the present embodiment, the first black head 4*k*1 in the first embodiment is not mounted, but a single black head 4*k* corresponding to the second black head 4*k*2 is mounted. The black head 4*k* is disposed at a position shifted by an amount equivalent to the width of one nozzle array in the sub-scanning direction downstream in the sheet conveying direction with respect to the color heads 4*c*.

This configuration can also provide the same functions and effects as those of the first embodiment. The reduction in the number of heads can reduce carriage weight.

Figure 7:
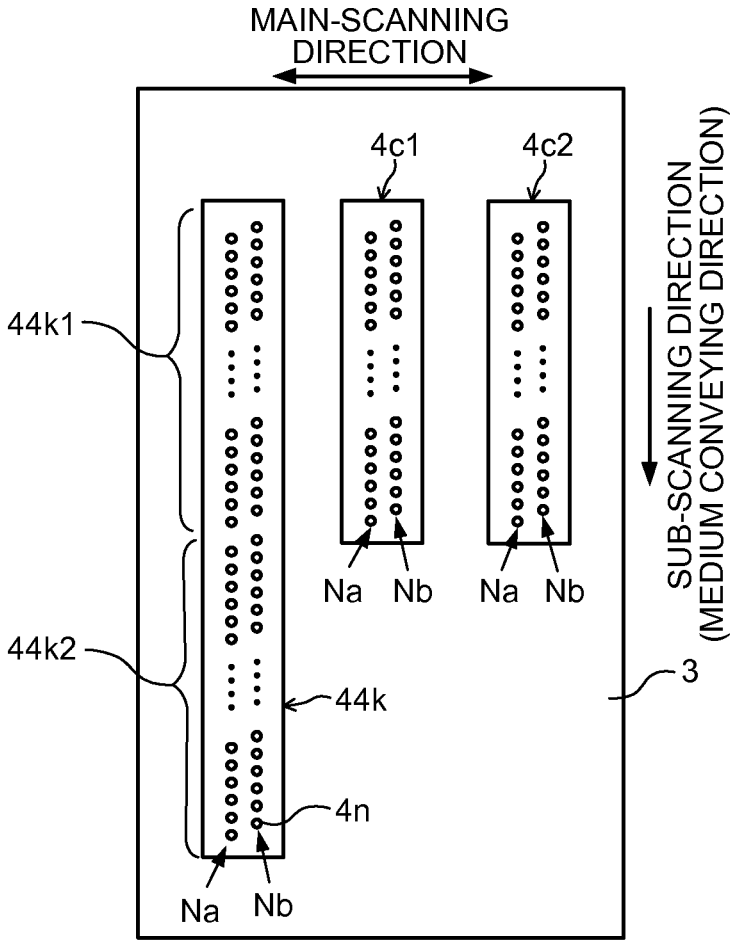
FIG. 7 is a diagram for explaining a configuration of heads in a third embodiment of the invention.

Next, a third embodiment of the invention will be described with reference to FIG. 7. FIG. 7 is a schematic diagram for explaining a head arrangement in the third embodiment.

In the third embodiment, mounted is a single black head 44*k* that is the first black head 4*k*1 in the first embodiment combined with the second black head 4*k*2. The black head 44*k* has a nozzle array section 44*k*1 that is at the same sub-scanning position as the color heads 4*c* and a nozzle array section 44*k*2 that is at a position shifted by an amount equivalent to the width of one nozzle array in the sub-scanning direction downstream in the sheet conveying direction with respect to the color heads 4*c*.

This configuration can also, by using the nozzle array section 44*k*2 of the black head 44*k*, provide the same operation as that of the first embodiment, whereby the same functions and effects as those of the first embodiment can be obtained.

Figure 8:
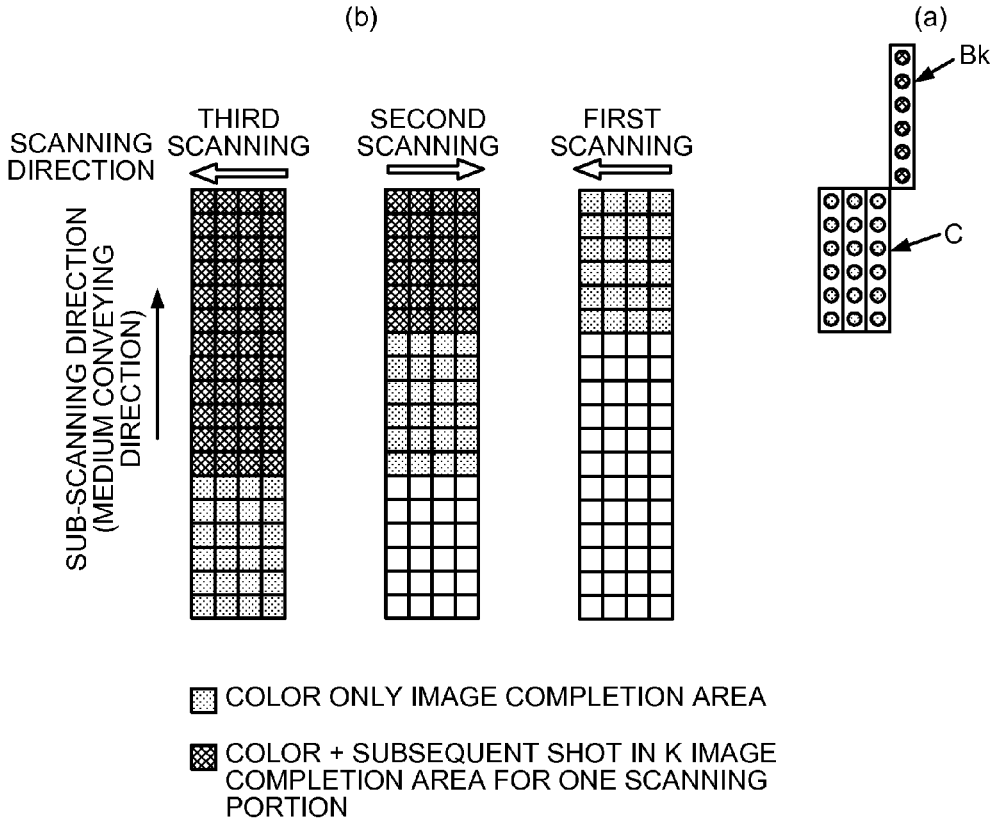
FIG. 8 illustrates a first example of an arrangement of a black nozzle array and color nozzle arrays in a sub-scanning direction and an image forming process from the first scan (first main-scanning) to the third scan (third main-scanning)
Figure 9:
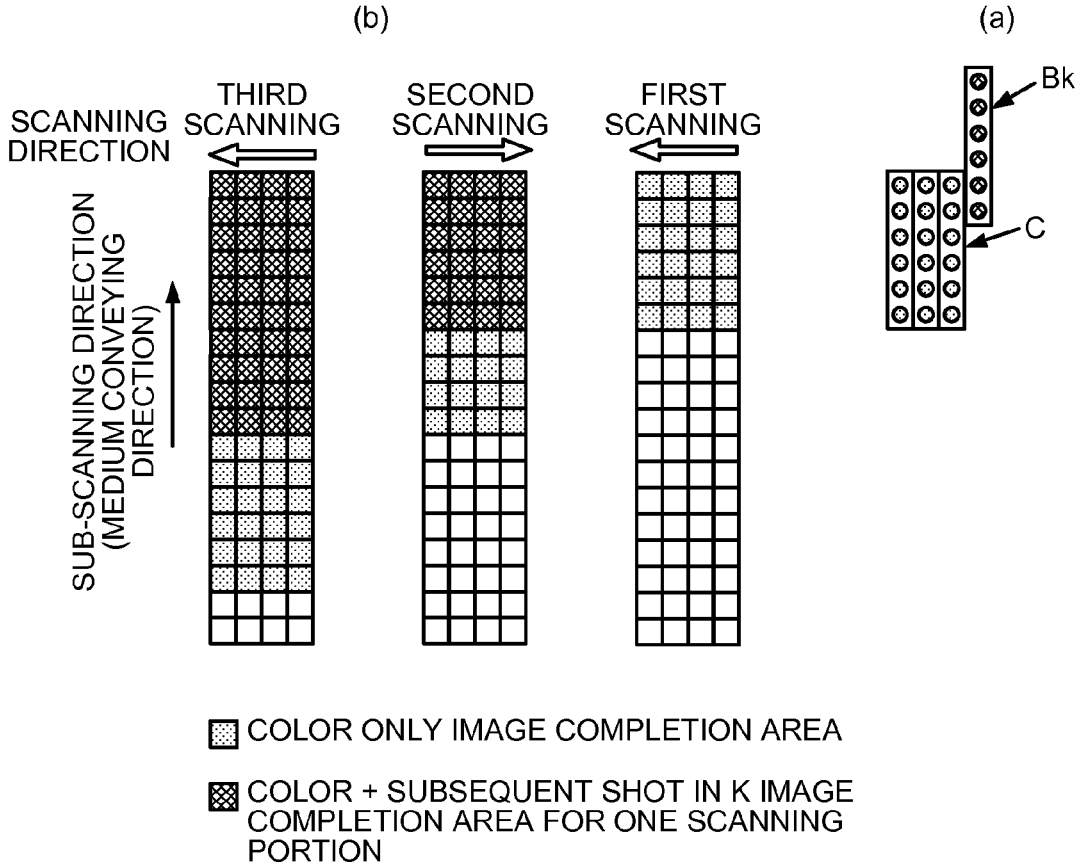
FIG. 9 illustrates a second example of an arrangement of a black nozzle array and color nozzle arrays in the sub-scanning direction and an image forming process from the first scan (first main-scanning) to the third scan (third main-scanning)
Figure 10:
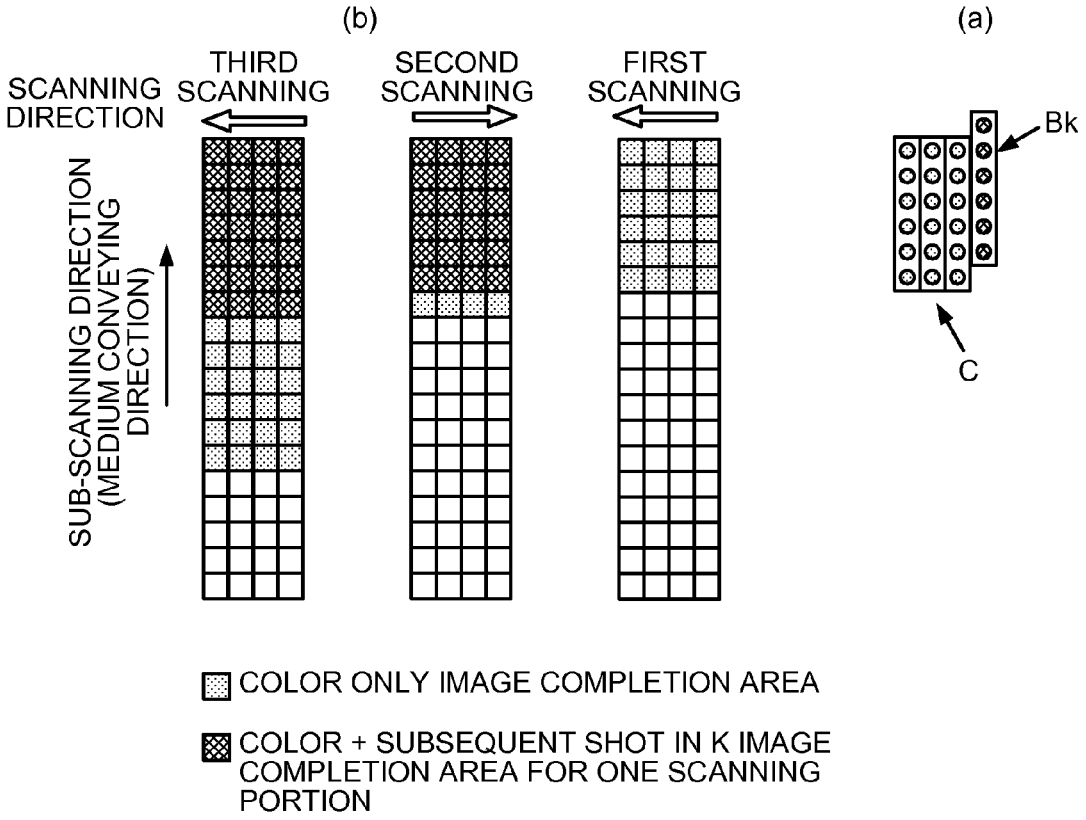
FIG. 10 illustrates a third example of an arrangement of a black nozzle array and color nozzle arrays in the sub-scanning direction and an image forming process from the first scan (first main-scanning) to the third scan (third main-scanning).

Next, examples of different arrangement of the black nozzle array and the color nozzle arrays in the sub-scanning direction (examples of head configuration) in the invention including the above-described embodiments will be described with reference to FIGS. 8 to 10. In FIGS. 8, 9, and 10, the respective (a) illustrate an arrangement relationship of nozzle arrays and the respective (b) illustrate image forming process from the first scan (the first round of main-scanning) to the third scan (the third round of main-scanning). Each of the nozzle arrays is explained as of six nozzles.

A first example illustrated in FIG. 8 is, as explained in the foregoing embodiments, an example of a black nozzle array Bk disposed being shifted downstream in the sub-scanning direction by an amount equivalent to one nozzle array (equivalent to six nozzles, here) with respect to color nozzle arrays C. In the first example, the conveying amount of a recording medium in each scan is equivalent to the six nozzles.

More specifically, in the first scan (scanning in one direction), a color only image corresponding to the six nozzles using the color nozzle arrays C is completed. The recording medium is then conveyed by an amount equivalent to the six nozzles, and in the second scan (scanning in the other direction), using the black nozzle array Bk, black droplets are ejected on the color only image completed in the first scan to complete the image, and using the color nozzle arrays C, a color only image corresponding to the subsequent six nozzles is completed. Thereafter, the recording medium is conveyed by an amount equivalent to the six nozzles, and in the third scan (scanning in one direction), black (K) droplets are ejected using the black nozzle array Bk on the color only image completed in the second scan to complete the image, and using the color nozzle arrays C, a color only image corresponding to the subsequent six nozzles is completed.

A second example illustrated in FIG. 9 is an example of the black nozzle array Bk made up of six nozzles which is disposed being shifted downstream in the sub-scanning direction by an amount equivalent to four nozzles with respect to color nozzle arrays C. In the second example, the conveying amount of a recording medium alternately becomes an amount equivalent to the six nozzles and an amount equivalent to the four nozzles.

More specifically, in the first scan (scanning in one direction), a color only image equivalent to the six nozzles is completed using the color nozzle arrays C. Then, the recording medium is conveyed by an amount equivalent to the four nozzles, and in the second scan (scanning in the other direction), using the six nozzles of the black nozzle array Bk, black droplets are ejected on the color only image completed in the first scan to complete the image, and using the four nozzles in each of the color nozzle arrays C not overlapping with the black nozzle array Bk (not overlapping in the main-scanning direction), a color only image corresponding to the four nozzles is completed. Thereafter, the recording medium is conveyed by an amount equivalent to the six nozzles, and in the third scan (scanning in one direction), black (K) droplets are ejected using the four nozzles of the black nozzle array Bk not overlapping with the color nozzle arrays C (not overlapping in the main-scanning direction) on the color only image corresponding to the four-nozzle array completed in the second scan to complete the image corresponding to the four nozzles, and using the color nozzle arrays C, a color only image corresponding to the subsequent six nozzles is completed.

A third example illustrated in FIG. 10 is an example of the black nozzle array Bk disposed being shifted downstream in the sub-scanning direction by an amount equivalent to one nozzle with respect to color nozzle arrays C. In the third example, the conveying amount of a recording medium alternately becomes an amount equivalent to six nozzles and an amount equivalent to the one nozzle.

More specifically, in the first scan (scanning in one direction), a color only image corresponding to the six nozzles is completed using the color nozzle arrays C. Then, the recording medium is conveyed by an amount of the one nozzle, and in the second scan (scanning in the other direction), using the six nozzles of the black nozzle array Bk, black droplets are ejected on the color only image completed in the first scan to complete the image, and using the one nozzle in each of the color nozzle arrays C not overlapping with the black nozzle array Bk (not overlapping in the main-scanning direction), a color only image corresponding to the one nozzle is completed. Thereafter, the recording medium is conveyed by an amount of the six nozzles, and in the third scan (scanning in one direction), black (K) droplets are ejected using the one nozzle of the black nozzle array Bk not overlapping with the color nozzle arrays C (not overlapping in the main-scanning direction) on the color only image corresponding to the one nozzle array completed in the second scan to complete the image corresponding to the one nozzle array, and using the color nozzle arrays C, a color only image corresponding to the subsequent six nozzles is completed.

As in the foregoing, the amount of shift between the black nozzle array and the color nozzle arrays in the sub-scanning direction can be selected in a range from an amount equivalent to one nozzle of one nozzle array to an amount equivalent to all nozzles thereof.

While the black nozzle array and the color nozzle arrays are constituted by a black head and a plurality of color heads in the above-described embodiments, as long as the positional relationship of the nozzle arrays is defined as above, all nozzle arrays can be configured as a single head.

The process concerning the above-described image forming is carried out by a computer in accordance with a computer program. The computer program can be provided by storing it in a storage medium, or can be provided by downloading it via a network such as the Internet. Furthermore, the image forming apparatus and the host (information processing apparatus) described in the above-described embodiments can be combined to constitute an image forming system.

According to the embodiments, a black nozzle array is disposed in a position shifted in a sub-scanning direction downstream in a medium conveying direction with respect to color nozzle arrays, and after an image is formed by the color nozzle arrays in a preceding main-scanning in one direction, a recording medium is relatively moved to a subsequent main-scanning position and an image by the black nozzle array is formed in the following main-scanning in the other direction on the image formed by the color nozzle arrays to complete an image for one main-scanning area. This allows black droplets to be shot always after color droplets in a simple configuration, whereby a reduction in bidirectional color difference and an improvement in gray quality can be achieved.

Although the invention has been described with respect to specific embodiments for a complete and clear disclosure, the appended claims are not to be thus limited but are to be construed as embodying all modifications and alternative constructions that may occur to one skilled in the art that fairly fall within the basic teaching herein set forth.

What is claimed is:

1. An image forming apparatus comprising:

a carriage that includes at least one head and is moved for scanning in a main-scanning direction, the head including a black nozzle array in which a plurality of nozzles for ejecting black droplets are arranged and a color nozzle array in which a plurality of nozzles for ejecting color droplets are arranged, the black nozzle array being disposed at a position shifted in a sub-scanning direction downstream in a medium conveying direction with respect to the color nozzle array;

a conveying unit configured to convey a recording medium in the sub-scanning direction; and a control unit configured to control forming a first line of an image by the color nozzle array in a first main scanning direction, moving the recording medium in the sub-scanning direction by an amount equivalent to the first line to a subsequent main-scanning position thereafter, and forming an image by only the black nozzle array on the first line of the image formed by the color nozzle array in a following main scanning in a second main-scanning direction so as to complete the first line of the image while simultaneously forming a second line of the image by the color nozzle array in the second main-scanning direction, wherein the first and second lines have a width substantially equivalent to a width of at least one of the color nozzle array and the black nozzle array.

2. The image forming apparatus according to claim 1, wherein the carriage further includes another black nozzle array in which a plurality of nozzles for ejecting black droplets are arranged, the another black nozzle array being disposed at a same position as the color nozzle array in the sub-scanning direction.

3. The image forming apparatus according to claim 1, wherein the black nozzle array includes a section disposed at a position shifted in the sub-scanning direction downstream in the medium conveying direction with respect to the color nozzle array, and a section disposed at a same position as the color nozzle array in the sub-scanning direction.

4. The image forming apparatus according to claim 1, wherein density of an image formed by the black nozzle array is higher than density of an image formed by the color nozzle array.

5. The image forming apparatus according to claim 1, wherein the black nozzle array is shifted relative to the color nozzle array by an amount substantially equivalent to a width of one nozzle array in the sub-scanning direction.

6. The image forming apparatus according to claim 1, wherein the control unit relatively moves the recording medium to a subsequent main-scanning position thereafter by an amount substantially equivalent to a width of one nozzle array in the sub-scanning direction.

7. A non-transitory computer-readable storage medium with an executable program for controlling an image forming apparatus and stored thereon, wherein the image forming apparatus comprises a carriage that includes at least one head and is moved for scanning in a main-scanning direction, the head including a black nozzle array in which a plurality of nozzles for ejecting black droplets are arranged and a color nozzle array in which a plurality of nozzles for ejecting color droplets are arrange, the black nozzle array being disposed at a position shifted in a sub-scanning direction downstream in a medium conveying direction with respect to the color nozzle array, and a conveying unit configured to convey a recording medium in the sub-scanning direction, and the program instructs a computer to perform:

forming a first line of an image by the color nozzle array in a first main scanning direction;

moving the recording medium in the sub-scanning direction by an amount equivalent to the first line to a subsequent main-scanning position thereafter; and forming an image by only the black nozzle array on the first line of the image formed by the color nozzle array in a following main scanning in a second main scanning direction so as to complete the first line if the image while simultaneously forming a second line of the image by the color nozzle array in the second main scanning direction, wherein the first and second lines have a width substantially equivalent to a width of at least one of the color nozzle array and the black nozzle array.

8. The non-transitory computer-readable storage medium according to claim 7, wherein the program further instructs a computer to perform forming an image by a black nozzle array that is shifted relative to the color nozzle array by an amount substantially equivalent to a width of one nozzle array in the sub-scanning direction.

9. The non-transitory computer-readable storage medium according to claim 7, wherein the program further instructs a computer to relatively move the recording medium to a subsequent main-scanning position thereafter by an amount substantially equivalent to a width of one nozzle array in the sub-scanning direction.

10. An image forming method for controlling an image forming apparatus, wherein the image forming apparatus comprises a carriage that includes at least one head and is moved for scanning in a main-scanning direction, the head including a black nozzle array in which a plurality of nozzles for ejecting black droplets are arranged and a color nozzle array in which a plurality of nozzles for ejecting color droplets are arrange, the black nozzle array being disposed at a position shifted in a sub-scanning direction downstream in a medium conveying direction with respect to the color nozzle array, and a conveying unit configured to convey a recording medium in the sub-scanning direction, the image forming method comprising:

forming a first line of an image by the color nozzle array in a first main scanning direction;

moving the recording medium in the sub-scanning direction by an amount equivalent to the first line to a subsequent main-scanning position thereafter; and forming an image by only the black nozzle array on the first line of the image formed by the color nozzle array in a following main scanning in a second main scanning direction so as to complete the first line if the image while simultaneously forming a second line of the image by the color nozzle array in the second main scanning direction, wherein the first and second lines have a width substantially equivalent to a width of at least one of the color nozzle array and the black nozzle array.

11. The image forming method according to claim 10, wherein the forming of the image by only the black nozzle array includes forming the image by a black nozzle array that is shifted relative to the color nozzle array by an amount substantially equivalent to a width of one nozzle array in the sub-scanning direction.

12. The image forming method according to claim 10, wherein the relatively moving includes relatively moving the recording medium to a subsequent main-scanning position thereafter by an amount substantially equivalent to a width of one nozzle array in the sub-scanning direction.

* * * * *